US010155239B2

(12) United States Patent
Sander et al.

(10) Patent No.: US 10,155,239 B2
(45) Date of Patent: Dec. 18, 2018

(54) SPRAY FOAM HOSE STORAGE SYSTEM

(71) Applicant: JNJ HOSE STORAGE RACKS, LLC, Sanford, FL (US)

(72) Inventors: Jason Sander, Lake Mary, FL (US); James L. Williams, Deland, FL (US)

(73) Assignee: JNJ HOSE STORAGE RACKS, LLC, Sanford, FL (US)

( * ) Notice: Subject to any disclaimer, the term of this patent is extended or adjusted under 35 U.S.C. 154(b) by 488 days.

(21) Appl. No.: 14/638,695

(22) Filed: Mar. 4, 2015

(65) Prior Publication Data

US 2016/0257526 A1 Sep. 8, 2016

(51) Int. Cl.
*B65H 75/36* (2006.01)
*B05B 15/62* (2018.01)
*B65H 75/44* (2006.01)

(52) U.S. Cl.
CPC ..... *B05B 15/62* (2018.02); *B65H 75/366* (2013.01); *B65H 75/44* (2013.01); *B65H 2701/33* (2013.01)

(58) Field of Classification Search
CPC ..... B05B 15/061; B65H 75/366; B65H 2701/33; B65H 75/44
USPC ..... 224/553; 410/143
See application file for complete search history.

(56) References Cited

U.S. PATENT DOCUMENTS 1,658,793 A * 2/1928 Hansen ..... A62C 33/04 137/355.18
1,870,322 A * 8/1932 Brown ..... A62C 33/04 137/355.18
2,681,251 A * 6/1954 Fortener ..... B67D 7/766 137/355.16
2,719,752 A * 10/1955 Dodge, Jr. ..... A62C 35/20 137/355.18
3,575,202 A * 4/1971 Turek ..... A62C 35/20 137/355.18
3,749,118 A * 7/1973 Berg ..... A62C 35/20 137/355.28
4,896,686 A 1/1990 Schmidt, Jr. et al.
5,046,582 A * 9/1991 Albrecht ..... B60R 3/02 182/127
5,076,630 A * 12/1991 Henriquez ..... B60R 11/06 224/401
5,326,204 A * 7/1994 Carlson ..... A47B 96/1466 211/183
5,419,362 A * 5/1995 Blackaby ..... A62C 33/04 137/355.16
5,950,846 A 9/1999 Duane
6,189,706 B1 2/2001 Akins
7,500,573 B1 3/2009 Flynn
(Continued)

*Primary Examiner* — Nathan J Newhouse
*Assistant Examiner* — Lester L Vanterpool
(74) *Attorney, Agent, or Firm* — Matthew G. McKinney, Esq.; Allen, Dyer, Doppelt + Gilchrist, PA

(57) ABSTRACT

A spray foam hose storage system includes a shaft and an elongated sleeve having the shaft concentrically positioned inside, where the elongated sleeve configured to rotate about the shaft. In addition, the system includes a cantilever arm having a proximate end and a distal end, a base plate securing the cantilever arm perpendicular to the elongated sleeve, where the cantilever arm is offset from the elongated sleeve by a distance. The cantilever arm includes a plurality of slats positioned to form a concave periphery for a spray foam hose to be draped back and forth thereon.

11 Claims, 4 Drawing Sheets

(56) References Cited

U.S. PATENT DOCUMENTS 8,616,383 B1 * 12/2013 Miller ..... B68C 1/002
211/1.51
9,380,890 B2 * 7/2016 Mustari ..... A47F 5/02

* cited by examiner

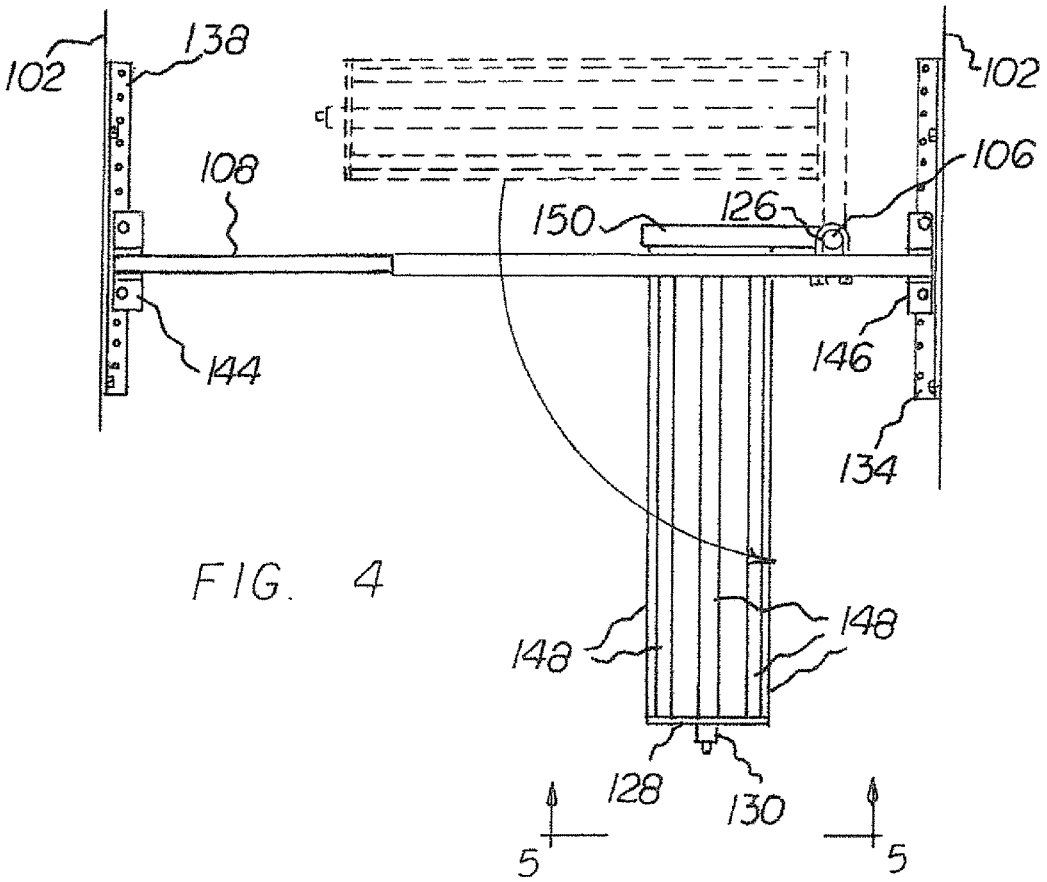
FIG. 4
FIG. 5
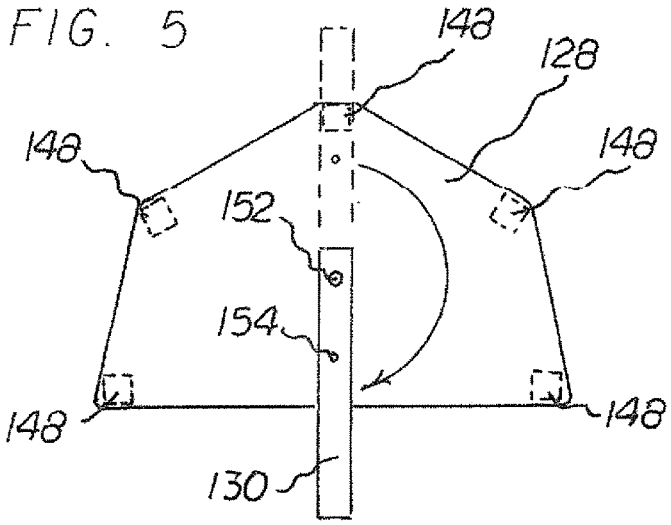

SPRAY FOAM HOSE STORAGE SYSTEM

FIELD OF THE INVENTION

The present invention relates in general to a spray foam hose storage system and method.

BACKGROUND

Spray foam is typically used in the construction industry with commercial roofing and wall insulation. Most applications require several hundred feet of hose to deliver the raw materials from the spray foam machine to the spray gun for application to the desired surface.

The spray foam chemicals typically are required to be heated to 120° F.-140° F. Heated spray foam hoses are necessary in order to maintain the chemicals at the required temperature until they are mixed and applied with the spray gun.

The spray foam hoses typically have a copper wire band that is spiral wrapped down the hose inside of a protective jacket. This wire is supplied with low voltage electricity at a pre-set electrical resistance level to create heat. The heat is conductively transferred from the outside of the hose into the liquid components within the hose. The lengths of the spray foam hoses are often 300 feet and longer and heavy.

The storage of the spray foam hoses are typically wound in a circular fashion around two or more pegs installed on a sidewall of a truck. Thus, to use the spray foam hose the operator will unwind the entire length of hose from the pegs and drag to the job site. When the job is finished, the operator will drag the spray foam hose along with dirt back into the truck in order to stow away the hose. The operator must also be careful not to create any sharp bends in the spray foam hose.

Accordingly, there is a need in the art for a spray foam hose storage system that allows the operator to quickly and easily access the spray foam hose from the truck, and also to be able to quickly and easily stow the spray foam hose when the job is done without damaging the spray foam hose.

SUMMARY

In a particular illustrative embodiment, a spray foam hose storage system is disclosed. The system includes a shaft and an elongated sleeve having the shaft concentrically positioned inside, where the elongated sleeve configured to rotate about the shaft. In addition, the system includes a cantilever arm having a proximate end and a distal end, and a base plate securing the cantilever arm perpendicular to the elongated sleeve, where the cantilever arm is offset from the elongated sleeve by a distance. The cantilever arm includes a plurality of slats positioned to form a concave periphery for a spray foam hose to be draped back and forth thereon.

In another particular illustrative embodiment, a method to store a spray foam hose is disclosed. The method includes swinging a cantilever arm out from a container, where the cantilever arm is secured to a sleeve mounted vertically inside the container and proximate an entry of the container. The method also includes draping the spray foam hose back and forth over the cantilever arm from outside the container, and swinging the cantilever arm back into the container, where the sleeve is positioned inside the container so that the entry to the container can be closed.

Other aspects, advantages, and features of the present disclosure will become apparent after review of the entire application, including the following sections: Brief Description of the Drawings, Detailed Description, and the Claims.

BRIEF DESCRIPTION OF THE DRAWINGS

FIG. 4 is a top view of the spray foam hose storage system taken along line 4-4 of FIG. 1;

FIG. 5 is a left side view of a cantilever arm taken along line 5-5 of FIG. 4.

DETAILED DESCRIPTION

Figure 1:
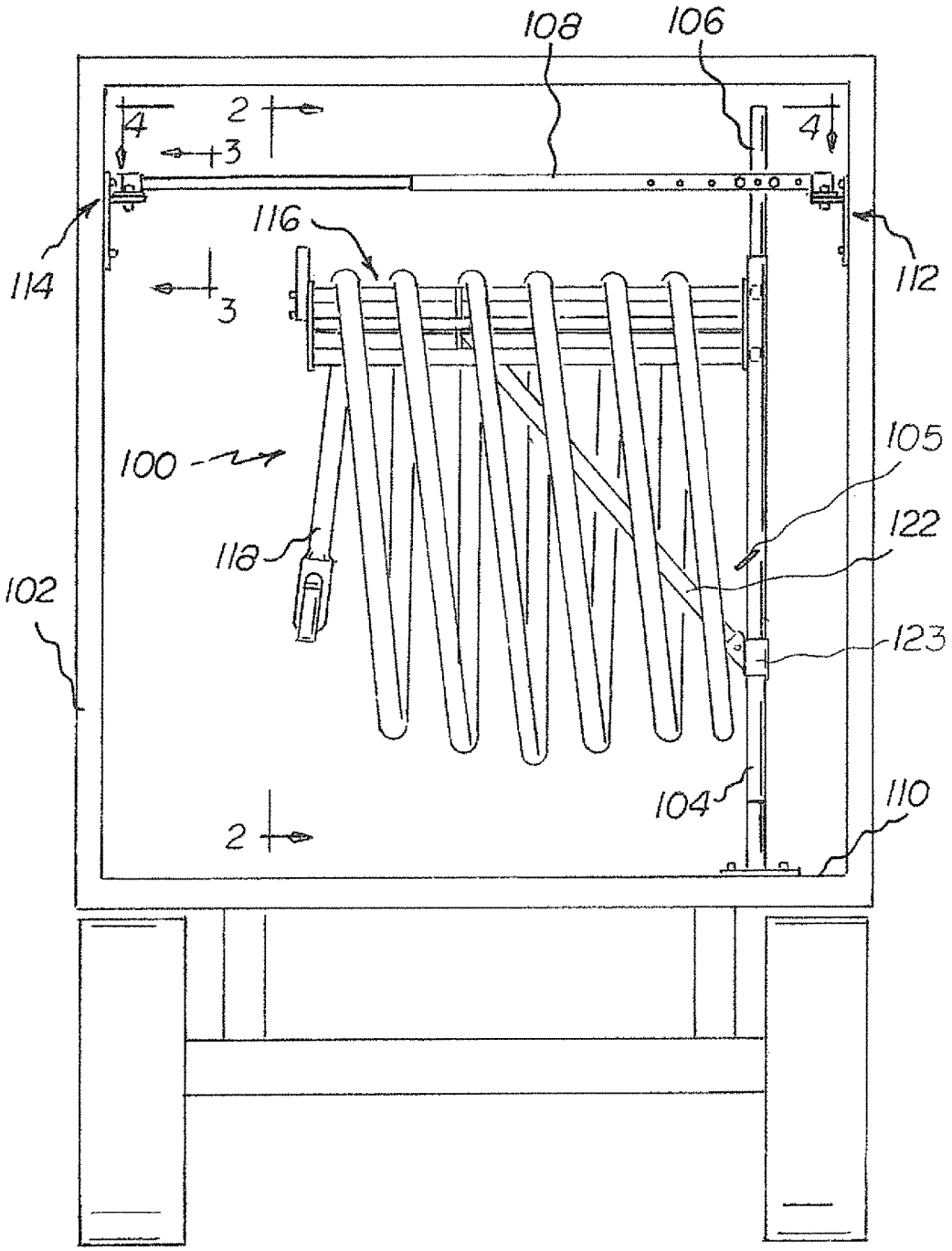
FIG. 1 is front view of a spray foam hose storage system installed in a box truck and loaded with a spray foam hose.

Referring now to FIG. 1, a spray foam hose storage system 100 is illustrated installed inside a box truck. The system 100 may be installed in any type of container and the box truck is a preferred embodiment for use of the spray foam hose storage system 100. An elongated sleeve 104 is orientated vertically from a floor 110 of the box truck towards the ceiling of the box truck. The elongated sleeve 104 is positioned between a center and a sidewall of the box truck. A shaft 106 is concentrically positioned inside the elongated sleeve 104. The shaft 106 is configured so that the elongated sleeve 104 can rotate about the shaft 106. A lower portion of the shaft 106 is secured to the floor 110 of the box truck using a foot 120. The foot 120 may be secured to the floor 110 using bolts through the floor 110 and connected to a channel (not shown) of the box truck that spans on the underside of floor 120.

In order to provide lateral support to the elongated sleeve 104 and shaft 106, a horizontal brace 108 spans between two opposing sidewalls 102 of the box truck. An upper portion of the shaft 106 is secured to the horizontal brace 108. The horizontal brace 108 is secured to the sidewall 102 using a first mounting assembly 112. On an opposing end of the horizontal brace 108 and mounted to an opposing sidewall 102 is a second mounting assembly 114. The horizontal brace 108 may be telescoping and adjustable in length in order to accommodate various widths of the box truck.

A cantilever arm 116 is secured to the elongated sleeve 104 at a distance from the floor 110 sufficient for a spray foam hose 118, draped back and forth over the cantilever arm 116, to be elevated off the floor 110. In another embodiment, the spray foam hose 118 may be partially touching the floor 110.

Figure 2:
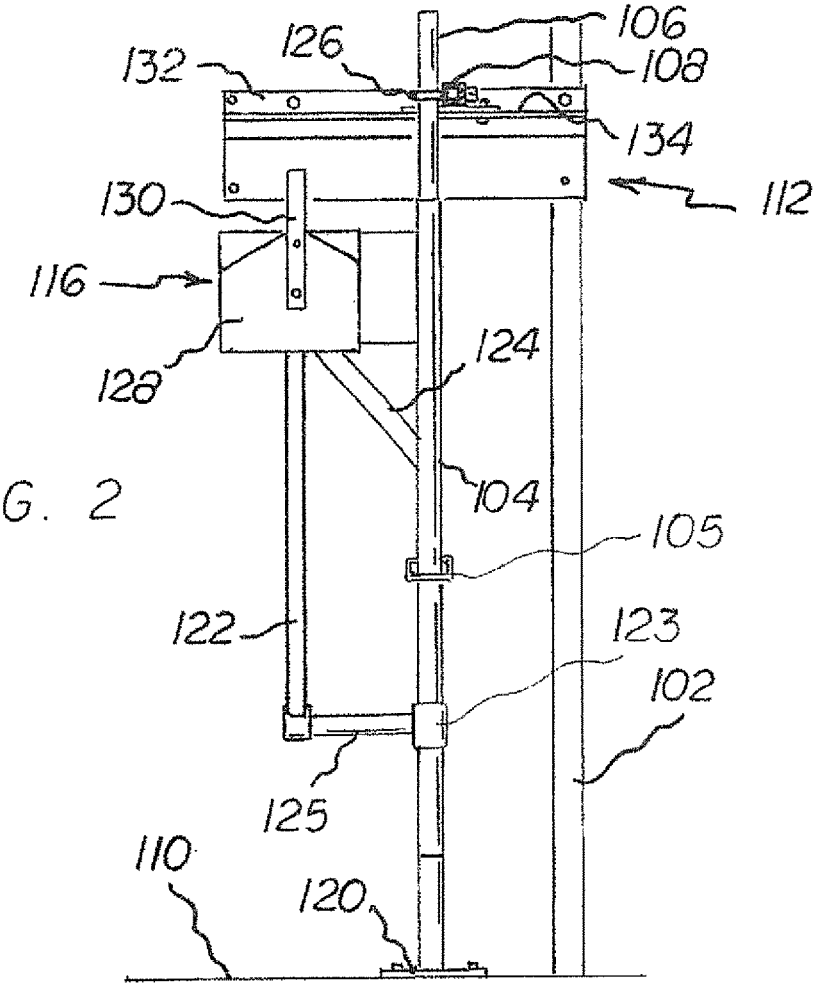
FIG. 2 is a left side view of the spray foam hose storage system taken along line 2-2 of FIG. 1; illustrates an example of an interleaving

The cantilever arm 116 is offset from the elongated sleeve 104 as shown in FIG. 2. A base plate 150 extends horizontally from the elongated sleeve 104 to the cantilever arm 116. An axis of the cantilever arm 116 from its proximate end to its distal end, is substantially perpendicular to the base plate 150 in order to provide the desired offset from the elongated sleeve 104. The offset is critical to the cantilever arm 116 being far enough inside the box truck 102 so that the door to the box truck can be closed when the cantilever arm 116 is swung inside the box truck 102, while at the same time the elongated sleeve 104 needs to be close as possible to the open end of the box truck (i.e., the entry) so that the spray foam hose 118 can be taken off and put back on the cantilever arm 116 from outside the box truck and not take up storage space inside the box truck. The box truck may have roll-up door or swing doors, for example.

A diagonal brace 122 extends from a lower strut 125 that is secured perpendicular to the elongated sleeve 104 to provide additional structural support to the cantilever arm 116. At the upper portion of the elongated sleeve 104, a U-bolt 126 may be used to secure the shaft 106 to the horizontal brace 108. However, any suitable connection may be used to secure the shaft 106 to the horizontal brace 108. A connector 123 is used to secure the lower strut 125 to the elongated sleeve 104. The connector 123 can be orientated on the elongated sleeve 104 so that the elongated sleeve 104 can be mounted proximate to either sidewall 102 of the box truck. As illustrated in FIG. 1, the elongated sleeve 104 is mounted proximate to a right side sidewall 102 so that the cantilever arm 116 can swing outwards from the box truck. Alternatively, the elongated sleeve 104 could be mounted proximate a left side sidewall 102 and the cantilever arm 116 could likewise swing outwards from the box truck. The connector 123 can be mounted for either side of the box truck and the lower strut 125 and the diagonal brace 122 adjusted accordingly, whichever side the elongated sleeve is mounted 104.

An end plate 128 is secured to the distal end of the cantilever arm 116, and is orientated in a vertical plane perpendicular to the axis of the cantilever arm 116. Pivotally mounted to the end plate 128 is a stop 130 secured to the distal end of the cantilever arm 116, the stop 130 is rotatable from a first position to a second position and configured to prevent the spray foam hose 118 from slipping off the distal end of the cantilever arm 116 when in the first position.

Also illustrated in FIG. 2 is the first mounting assembly 112, which includes a first mounting plate 132 to mount flush to the sidewall 102 of the box truck. A lip 134 extends from the mounting plate 132 so that an end of the horizontal brace 108 can rest thereon. A first seat 146 for the horizontal brace 108 is mounted to the first lip 134 and used to secure the horizontal brace 108 to the second mounting assembly 114.

Figure 3:
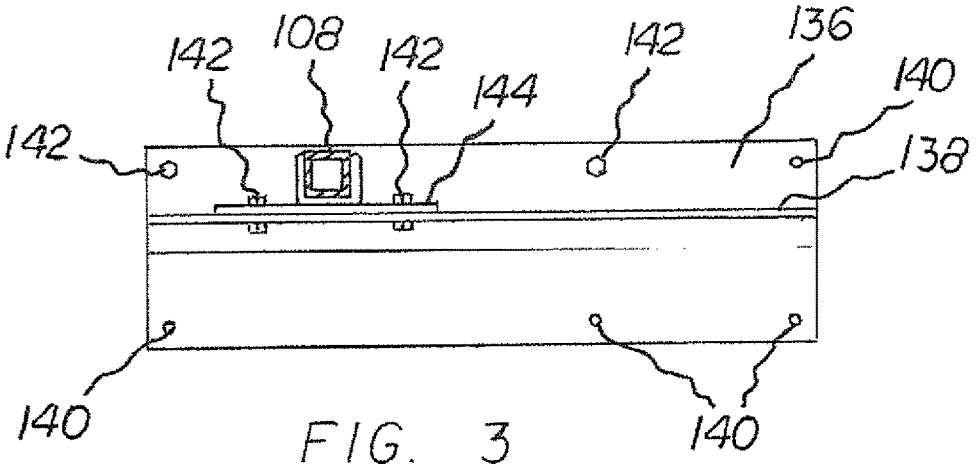
FIG. 3 is a right side view of a mounting assembly taken along line 3-3 of FIG. 1.

A similar second mounting assembly 114 is secured to an opposing sidewall from the first mounting assembly 112 as shown in FIG. 3. The second mounting assembly 114 includes a second mounting plate 136 to mount flush to the sidewall 102 of the box truck and a second lip 138 to support a second end of the horizontal brace 108. A second seat 144 for the horizontal brace 108 is mounted to the second lip 138 and used to secure the horizontal brace 108 to the second mounting assembly 114. The second mounting plate 136 (as well as the first mounting plate 132) has a plurality of mounting holes 140 and bolts 142 that are used to secure the second mounting plate 136 to the sidewall 102. Often times the sidewalls 102 of a box truck and other similar containers are relatively flimsy and made of thin sheet metal.

Accordingly, the attachment of the first and second mounting plates 132, 136 is typically distributed over a larger surface. The moment of force on the elongated sleeve 104 is increased significantly by the weight of the spray foam hose 118 when loaded on the cantilever arm 116 so that the mounting plates 132, 136 and the horizontal brace 108 supported between them must be secure in order not to rip the bolts from the sidewalls 102.

Referring now to FIG. 4, in operation the cantilever arm 116 swings from the first position to the second position about the shaft 106. The axis of the cantilever arm 116 being substantially parallel with the orientation of the horizontal brace 108 as shown in the top view of FIG. 4. A removable pin 105 may be inserted in the elongated sleeve 104 in order to secure the cantilevered arm 116 into the first or the second position. The cantilever arm 116 includes a plurality of slats 148 positioned to form a concave periphery for the spray foam hose 118 to be draped back and forth thereon. The spray foam hose 118 is typically stored without any sharp bends in order to protect electrical elements inside.

For example, the spray foam hose 118 commonly uses a copper wire band that is spiral wrapped down the hose 118 inside of a protective jacket. The wire is supplied with low voltage electricity at a pre-set electrical resistance level to create heat. The heat is conductively transferred from the outside of the hose 118 into the liquid foam chemicals within the hose 118. Accordingly, it is important not to have sharp bends in the spray foam hose 118 that would damage the copper wire band and impact the ability to create heat.

The slats 148 that form the concave periphery are positioned so that the spray foam hose 118 does not have any sharp bends as the hose 118 is draped over the top. The slats 148 may be box beams, for example, or could also be a contiguous flat surface, or any other structure that can form the concave periphery to support the spray foam hose 118. In any event, the width of the cantilever arm 116 is necessary to avoid any sharp bends in the spray foam hose 118 when draping over the cantilever arm 116 so that a portion being draped over a first side of the cantilever arm 116 is spaced apart from a portion of the spray foam hose 116 on the second side of the cantilever arm 116.

Referring now to FIG. 5, the end plate 128 that is secured to the distal end of the cantilever arm 116 is illustrated. The slats 148 have their respective distal ends secured to the end plate 128. The stop 130 is shown being rotated from the first position to the second position about a center pin 152 and locked in place with stop pin 154. When the stop 130 is in the first position and extending upwards beyond an edge of the end plate 148, the stop 130 prevents the spray foam hose 118 from slipping off the distal end of the cantilever arm 116. When unloading the spray foam hose 118 from the cantilever arm 116, the stop 130 can be rotated downward to the second position to allow the spray foam hose 118 to slide off the distal end of the cantilever arm 116.

Figure 6:
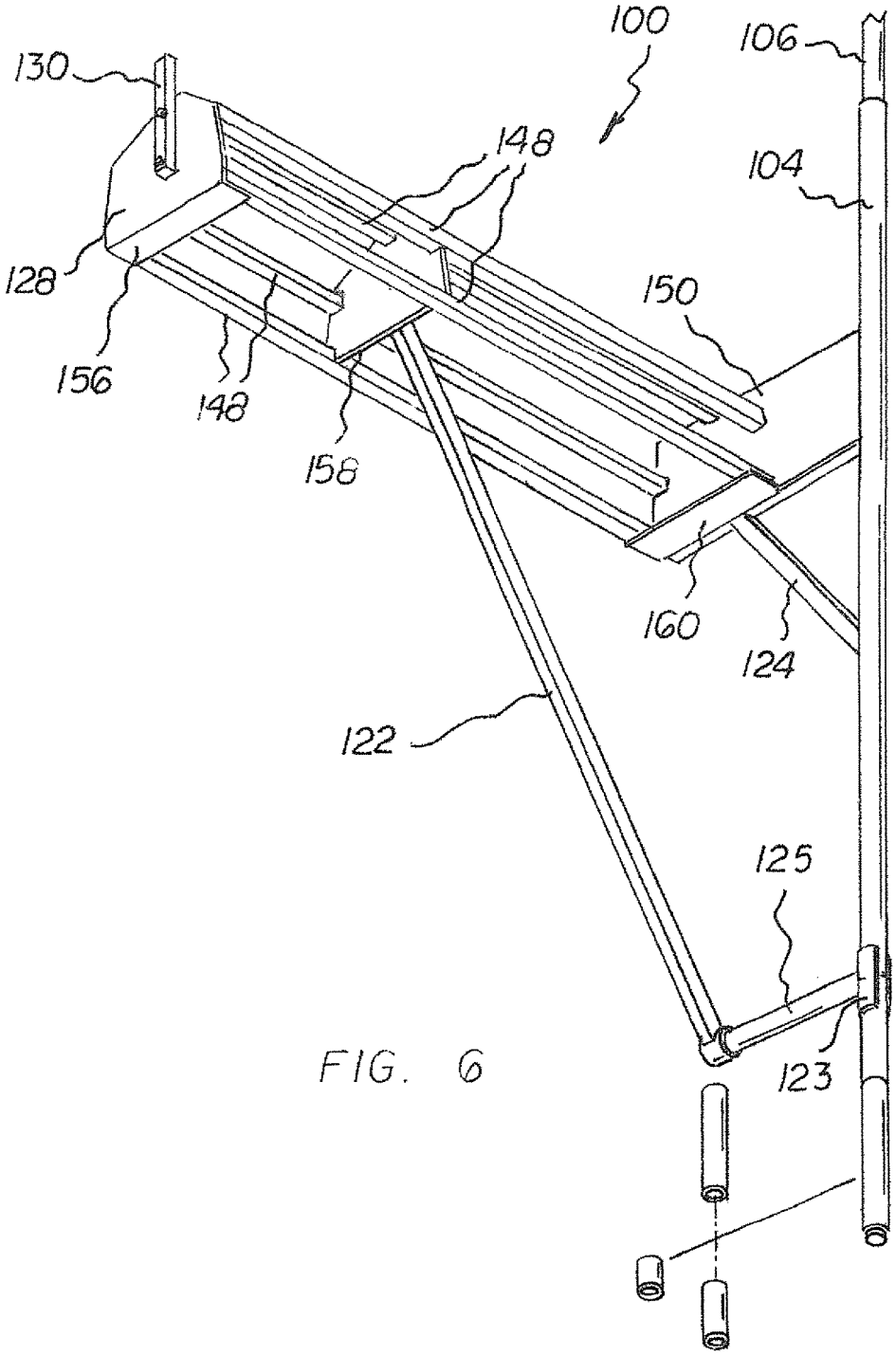
FIG. 6 is a perspective view of the cantilever arm.

The structure of the cantilever arm 116 is best illustrated in FIG. 6. In particular, the offset of the cantilever arm 116 from the elongated sleeve 104 and shaft 106 is clearly visible. As explained above, the base plate 150 is perpendicular to the elongated sleeve 104, and the axis of the cantilever arm 116 is perpendicular to the base plate 150. This unique orientation of the cantilever arm 116 to the elongated sleeve 104 allows the elongated sleeve 104 to be mounted close to the entry of the box truck, while also allowing the cantilever arm 116 to be rotated inside the box truck and allow the door of the box truck to be closed. The end plate 128 may have a lower lip 156 that can provide additional lateral support to the cantilever arm 116. A center plate 158 is disposed between the end plate 128 and the base plate 150 for additional stiffness and support of the slats 148 and to secure the diagonal brace 122. A lip 160 of the base plate 150 at the proximate end of the cantilever arm 116 also provides additional lateral support to the cantilever arm 116. A diagonal strut 124 may be secured between the cantilever arm 116 and the elongated sleeve 104 in order to provide additional structural support to the cantilever arm 116. In addition, the lower end of the elongated sleeve 104 may have interchangeable collars of different lengths that can be used to adjust a height of the elongated sleeve 104.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

The invention claimed is:

1. A spray foam hose storage system, the system comprising:

a vertical shaft;

an elongated sleeve rotatably positioned surrounding the vertical shaft;

a cantilever arm having a proximal end and a distal end;

a base plate having a first end and an opposing second end, the first end fixed to the proximal end of the cantilever arm so that the base plate is fixed to the cantilever arm and extends transverse therefrom, and the second end fixed to the elongated sleeve, wherein the cantilever arm is offset a horizontal distance from the elongated sleeve by the base plate;

an end plate secured to the distal end of the cantilever arm;

the cantilever arm having a plurality of elongated slats, wherein each elongated stat of the plurality of elongated slats having a first end secured to the base plate and a second end secured to the end plate, the plurality of elongated slats extending perpendicular to the vertical shaft;

a center plate positioned between the base plate and the end plate along the cantilever arm to support the plurality of elongated slats;

a lower strut fixed perpendicular to the elongated sleeve and parallel to the base plate; and a diagonal brace extending upward from the lower strut to the center plate to support the cantilever arm.

2. The spray foam hose storage system of claim 1, wherein the cantilever arm is configured to rotate in a horizontal plane between a first position and a second position.

3. The spray foam hose storage system of claim 1, further comprising a horizontal brace above the cantilever arm, wherein the vertical shaft is secured to the horizontal brace.

4. The spray foam hose storage system of claim 1, further comprising a foot configured to receive a lower end of the vertical shaft therein and to support the vertical shaft vertically.

5. The spray foam hose storage system of claim 1, further comprising a stop secured to the distal end of the cantilever arm, the stop rotatable from a first position to a second position and configured to prevent the spray foam hose from slipping off the distal end when in the first position.

6. The spray foam hose storage system of claim 1, further comprising a connector to secure the vertical shaft to the horizontal brace.

7. A method to store a spray foam hose using a storage system comprising a vertical shaft, an elongated sleeve rotatably positioned surrounding the vertical shaft, a cantilever arm having a proximal end and a distal end, a base plate having a first end and an opposing second end wherein the first end fixed to the proximal end of the cantilever arm so that the base plate is fixed to the cantilever arm and extends transverse therefrom and the second end fixed to the elongated sleeve, wherein the cantilever arm is offset a horizontal distance from the elongated sleeve by the base plate, an end plate secured to the distal end of the cantilever arm, the cantilever arm having a plurality of elongated slats wherein each elongated slat of the plurality of elongated slats having a first end secured to the base plate and a second end secured to the end plate and the plurality of elongated slats extending perpendicular to the vertical shaft, a center plate positioned between the base plate and the end plate along the cantilever arm to support the plurality of elongated slats, a lower strut fixed perpendicular to the elongated sleeve and parallel to the base plate, and a diagonal brace extending upward from the lower strut to the center plate to support the cantilever arm, the method comprising:

swinging the cantilever arm out from a first position inside a container;

draping the spray foam hose back and forth over the cantilever arm; and swinging the cantilever arm between the first position inside the container to a second position outside the container, wherein the elongated sleeve is positioned inside the container so that the entry to the container can be closed when the cantilever arm is in the first position.

8. The method to store a spray foam hose of claim 7, wherein the container is a box truck.

9. The method to store a spray foam hose of claim 7, wherein the entry of the container is closed using a roll-up door.

10. The method to store a spray foam hose of claim 7, wherein the entry of the container is closed using a swing door.

11. The method to store a spray foam hose of claim 7, wherein the cantilever arm is supported by a horizontal brace spanning between a pair of opposing walls of the container.

* * * * *